US011565273B1

(12) United States Patent
Ribeiro et al.

(10) Patent No.: US 11,565,273 B1
(45) Date of Patent: Jan. 31, 2023

(54) MAGNETIC POLE WITH REMOVABLE HEAD FOR USE IN MAGNETIC SEPARATOR

(71) Applicants: Cláudio Henrique Teixeira Ribeiro, Ellicott City, MD (US); José Pancrácio Ribeiro, Nova Lima (BR)

(72) Inventors: Cláudio Henrique Teixeira Ribeiro, Ellicott City, MD (US); José Pancrácio Ribeiro, Nova Lima (BR)

( * ) Notice: Subject to any disclaimer, the term of this patent is extended or adjusted under 35 U.S.C. 154(b) by 0 days.

(21) Appl. No.: 17/528,688

(22) Filed: Nov. 17, 2021

(51) Int. Cl.
*B03C 1/12* (2006.01)

(52) U.S. Cl.
CPC ..... *B03C 1/12* (2013.01)

(58) Field of Classification Search
CPC ..... B03C 1/12; B03C 1/031; B03C 1/03
See application file for complete search history.

(56) References Cited

U.S. PATENT DOCUMENTS 1,199,947 A * 10/1916 Walker et al. ..... B23Q 3/152 335/289
3,375,925 A * 4/1968 Carpenter ..... B03C 1/03 209/217
3,830,367 A * 8/1974 Stone ..... B03C 1/0335 209/222
4,496,457 A * 1/1985 Schickel ..... B03C 1/03 209/222
8,292,276 B2 * 10/2012 Cardone ..... B25B 11/002 335/289
2008/0074223 A1 * 3/2008 Pribonic ..... H01F 7/0221 335/306

FOREIGN PATENT DOCUMENTS

CN 111151376 A * 5/2020
DE 102014013459 A1 * 3/2016 ..... B03C 1/002

* cited by examiner

*Primary Examiner* — Patrick H Mackey
(74) *Attorney, Agent, or Firm* — Smith, Gambrell & Russell, LLP

(57) ABSTRACT

A magnetic pole for use in a magnetic separator comprises a body having a central core and two cantilevered pole arms, each pole arm extending at a perpendicular angle relative to the central core and having a faceplate at and end thereof, wherein at least one cantilevered pole arm and corresponding faceplate thereof are adapted for selective removal and re-attachment of the faceplate with the cantilevered pole arm.

31 Claims, 9 Drawing Sheets

MAGNETIC POLE WITH REMOVABLE HEAD FOR USE IN MAGNETIC SEPARATOR

FIELD OF THE INVENTION

The present invention relates to magnetic poles for use in magnetic separators for the separation of magnetic and non-magnetic particles in material feeds. In particular, the present invention concerns magnetic poles formed with a selectively removable and replaceable head, and methods of making and using the same with magnetic separators.

BACKGROUND OF THE INVENTION

In a typical magnetic separation process, a raw material containing both magnetic and non-magnetic components is caused to flow through a magnetic separator having one or more magnetic matrices for separating the magnetic and non-magnetic components. The material feed may be the raw material alone (e.g., a dry material feed) or a slurry formed from mixing the raw material with a fluid (e.g., a wet material feed).

In conventional magnetic separators, several magnetic matrices are caused to rotate in close proximity to a magnetic pole while the raw material feed passes through the matrices for separation. This arrangement inevitably results in some quantity of the material feed passing through a relatively small spacing between an outer surface of a matrix and a face of the magnetic pole, resulting in wear to the face of the magnetic pole. Over time, continued wear results in an irregular surface at the face of the magnetic pole, which causes irregularities in the magnetic field produced by the pole, which leads to efficiency losses in operation of the system.

Once a pole has incurred significant wear, it is conventional practice to repair the face of that pole, typically by filling irregularities in the surface with welding materials followed by surface machining to bring the face into conformity. However, this conventional practice is labor intensive, requiring disassembly of the magnetic separator with temporary removal of components in order to access the face of the pole. As these systems are normally massive in scale, the disassembly and removal of components requires high-load bearing heavy equipment. Furthermore, the welding and machining itself is a complex process due to the presence of residual magnetic fields within the metals, with the process typically requiring anywhere from several days to a few weeks to complete, during which time the magnetic separator is offline, resulting in a total loss of throughput from the system. Furthermore, even after completion of the repair process, imprecisions in the welding and machining to the face of the magnetic pole will lead to persistent irregularities in the magnetic field, with continued losses to efficiency in operation of the system.

Thus, there remains a need for an improved means and practice for remedying wear incurred to the face of magnetic poles in magnetic separators, and for improving the efficiencies of magnetic separators generally.

SUMMARY OF THE INVENTION

A magnetic pole for use in a magnetic separator comprises a body having a central core and two cantilevered pole arms, each pole arm extending at a perpendicular angle relative to the central core and having a faceplate at and end thereof, wherein at least one cantilevered pole arm and corresponding faceplate thereof are adapted for selective removal and re-attachment of the faceplate with the cantilevered pole arm.

At least one cantilevered pole arm and a corresponding faceplate may be provided with a connection mechanism that facilitates selective removal and re-attachment of the faceplate with the cantilevered pole arm. The connection mechanism may comprise mating first and second fastener elements adapted to engage one another for selectively securing the faceplate with the cantilevered pole arm; and/or may comprise mating first and second contoured surfaces adapted to engage one another for selectively securing the faceplate with the cantilevered pole arm.

The first fastener elements may comprise a number of threaded shafts adapted for passing through through-holes in the faceplate and the second fastener elements may comprise a number of corresponding threads provided within blind holes in the cantilevered pole arm, with the threaded shafts and corresponding threads in the blind holes being configured to selectively engage and disengage one another for selectively attaching and removing the faceplate with the cantilevered pole arm. The through-holes in the faceplate and the blind holes in the cantilevered pole arm may extend in a direction parallel with a length of the cantilevered pole arm, or may extend in a direction perpendicular with a length of the cantilevered pole arm. The faceplate may comprise one or more chamfered surfaces oriented at an oblique angle relative to the length of the cantilevered pole arm, and through-holes may be provided with an opening at the chamfered surfaces.

At least one of the cantilevered pole arm and the faceplate may comprise a protuberance, and the other of the cantilevered pole arm and the faceplate may comprise a recess, the protuberance and the recess being configured for mating engagement with reception of the protuberance in the recess, with such mating engagement of the protuberance within the recess serving to position the faceplate relative to the cantilevered pole arm for alignment of through-holes in the faceplate with blind-holes in the cantilevered pole arm.

Mating first and second contoured surfaces may comprise stepped surfaces, each having a relatively recessed region and a relatively protruding region, with the relatively protruding region of the stepped surface in the faceplate being adapted for reception in the relatively recessed region of the stepped surface in the cantilevered pole arm, and the relatively protruding region of the stepped surface in the cantilevered pole arm being adapted for reception in the relatively recessed region of the stepped surface in the faceplate.

The mating first and second contoured surfaces may be configured to join one another to form a dovetail joint, with one of the cantilevered pole arm and the faceplate provided with a dovetail recess and the other of the cantilevered pole arm and the faceplate provided with a dovetail protuberance, the dovetail protuberance being dimensioned for reception within the dovetail recess via a sliding movement, horizontally or vertically, in which the dovetail protuberance is slid through a recess opening of the dovetail recess for reception in the dovetail recess to form a dovetail joint.

The present invention is inclusive of magnetic poles as described above, as well as magnetic separators that have magnetic poles as described above.

Both the foregoing general description and the following detailed description are exemplary and explanatory only and are intended to provide further explanation of the invention as claimed. The accompanying drawings are included to provide a further understanding of the invention; are incorporated in and constitute part of this specification; illustrate embodiments of the invention; and, together with the description, serve to explain the principles of the invention.

BRIEF DESCRIPTION OF THE DRAWINGS

Further features and advantages of the invention can be ascertained from the following detailed description that is provided in connection with the drawings described below.

DETAILED DESCRIPTION OF THE INVENTION

Figure 1:
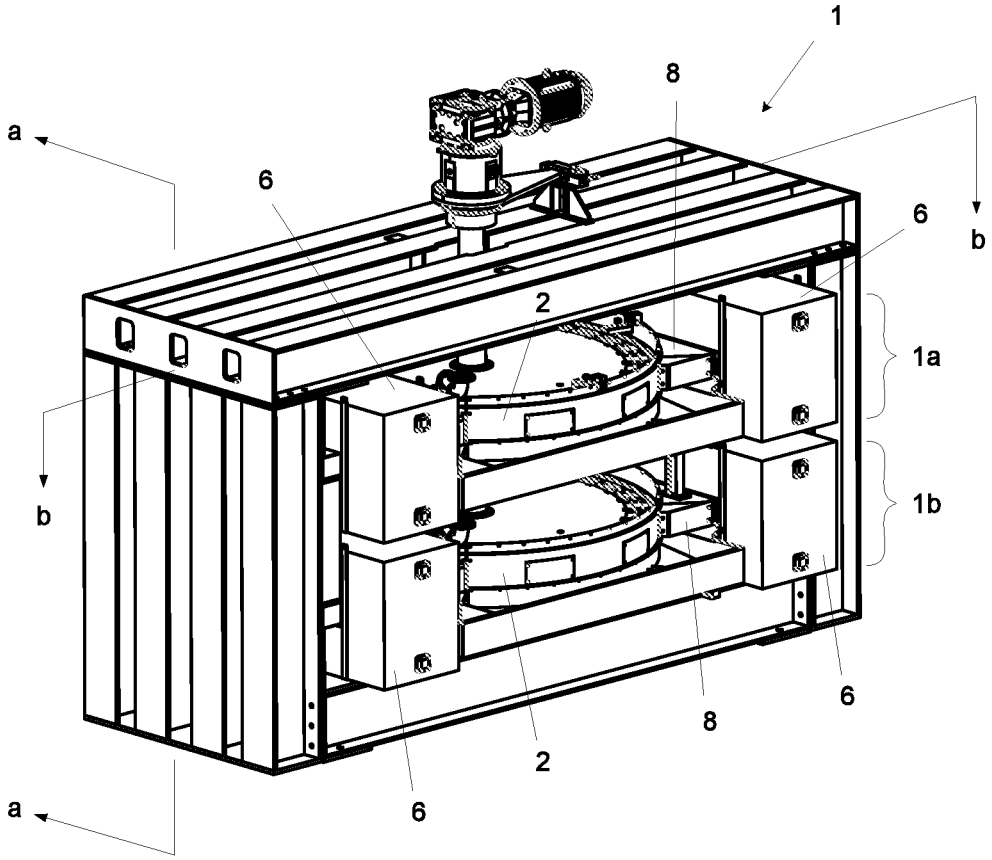
FIG. 1 shows a perspective view of a conventional magnetic separator.

The following disclosure discusses the present invention with reference to the examples shown in the accompanying drawings, though does not limit the invention to those examples.

The use of any and all examples, or exemplary language (e.g., "such as") provided herein is intended merely to better illuminate the invention and does not pose a limitation on the scope of the invention unless otherwise claimed. No language in the specification should be construed as indicating any non-claimed element as essential or otherwise critical to the practice of the invention, unless otherwise made clear in context.

As used herein, the singular forms "a," "an," and "the" include plural referents unless the context clearly dictates otherwise. Unless indicated otherwise by context, the term "or" is to be understood as an inclusive "or." Terms such as "first", "second", "third", etc. when used to describe multiple devices or elements, are so used only to convey the relative actions, positioning and/or functions of the separate devices, and do not necessitate either a specific order for such devices or elements, or any specific quantity or ranking of such devices or elements.

The word "substantially", as used herein with respect to any property or circumstance, refers to a degree of deviation that is sufficiently small so as to not appreciably detract from the identified property or circumstance. The exact degree of deviation allowable in a given circumstance will depend on the specific context, as would be understood by one having ordinary skill in the art.

Use of the terms "about" or "approximately" are intended to describe values above and/or below a stated value or range, as would be understood by one having ordinary skill in the art in the respective context. In some instances, this may encompass values in a range of approx. +/−10%; in other instances, there may be encompassed values in a range of approx. +/−5%; in yet other instances values in a range of approx. +/−2% may be encompassed; and in yet further instances, this may encompass values in a range of approx. +/−1%.

It will be understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof, unless indicated herein or otherwise clearly contradicted by context.

Recitations of value ranges herein, unless indicated otherwise, serve as shorthand for referring individually to each separate value falling within the respective ranges, including the endpoints of the range, each separate value within the range, and all intermediate ranges subsumed by the overall range, with each incorporated into the specification as if individually recited herein.

Unless indicated otherwise, or clearly contradicted by context, methods described herein can be performed with the individual steps executed in any suitable order, including: the precise order disclosed, without any intermediate steps or with one or more further steps interposed between the disclosed steps; with the disclosed steps performed in an order other than the exact order disclosed; with one or more steps performed simultaneously; and with one or more disclosed steps omitted.

Figure 2:
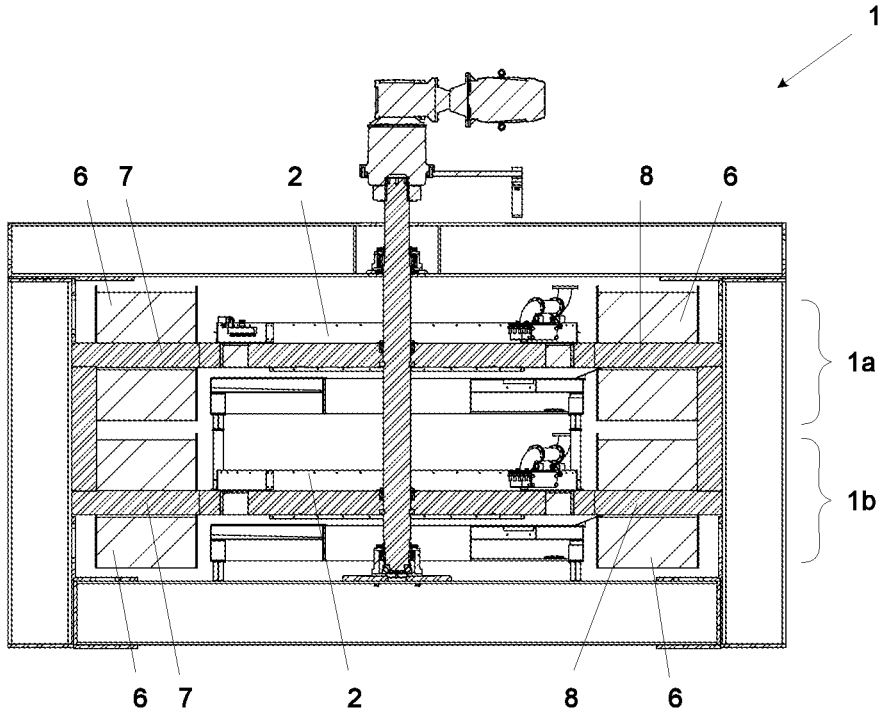
FIG. 2 shows a front elevation cross-sectional view of the magnetic separator in FIG. 1, as seen along line a-a in FIG. 1.
Figure 3:
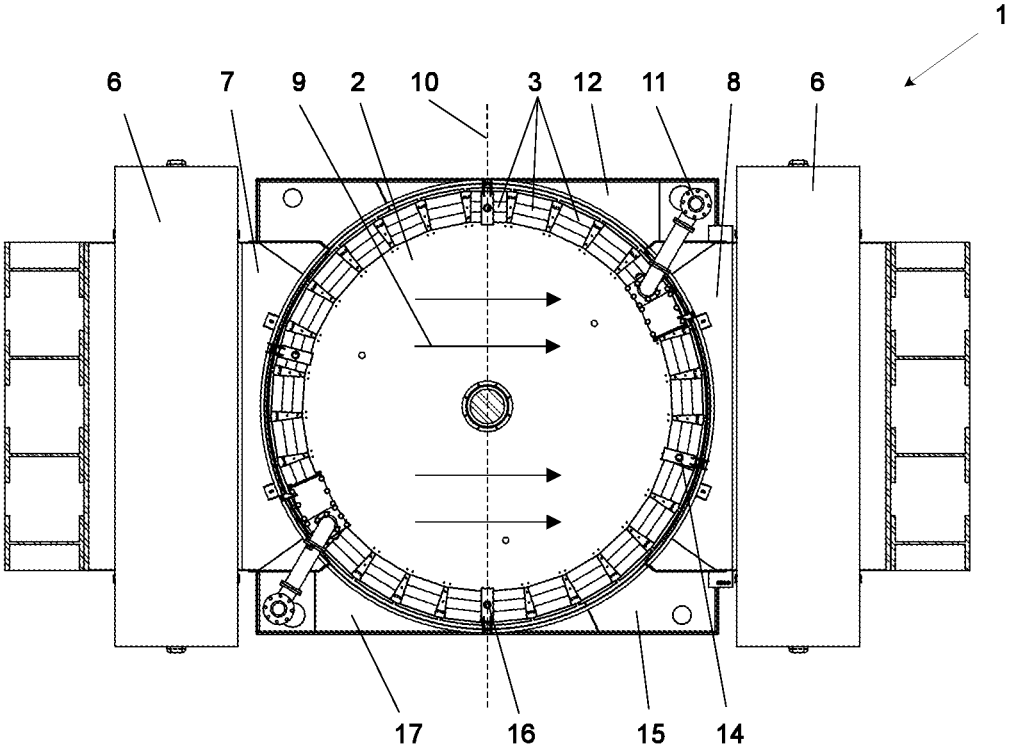
FIG. 3 shows a top plan cross-sectional view of the magnetic separator in FIG. 1, as seen along line b-b in FIG. 1.
Figure 4:
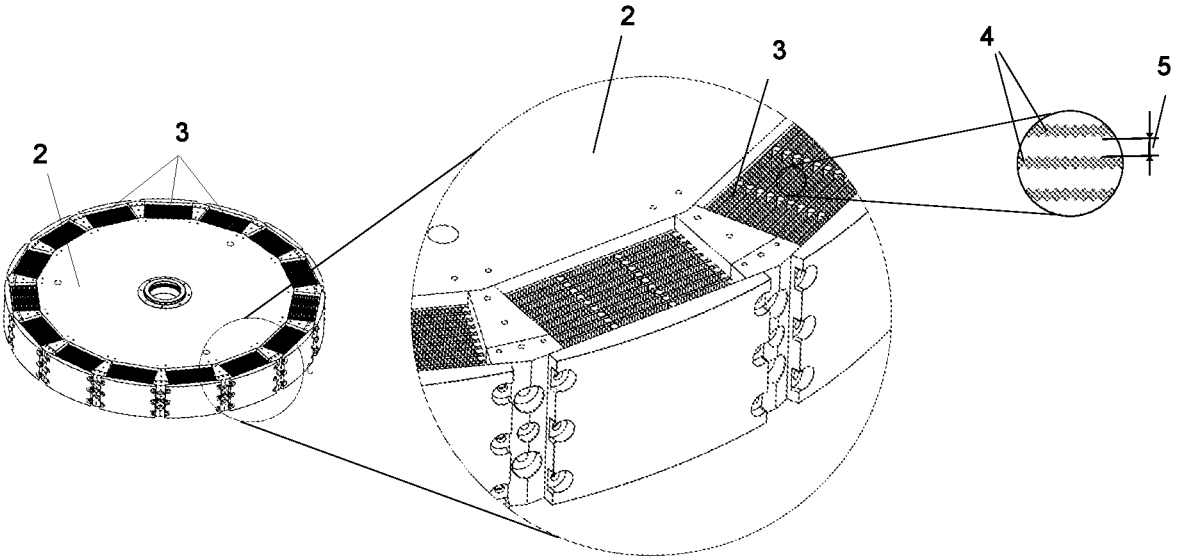
FIG. 4 shows an isolated view of the rotor in the magnetic separator of FIG. 1, with a close-up view of a magnetic separator in the rotor.

FIGS. 1-6 show a conventional magnetic separator 1, such as that disclosed in U.S. Pat. No. 3,830,367 (Stone), which is operable to separate magnetic and non-magnetic components in a wet-process. The magnetic separator 1 is a multi-tier separator with two separator units 1*a*/1*b* stacked one above the other, with each separator unit having a rotor 2 that carries a series of magnetic matrices 3 and a pair of poles 7/8 positioned at opposite sides of the rotor 2. FIG. 2 shows a front elevation cross-sectional view of the magnetic separator 1, as seen along line a-a in FIG. 1; and FIG. 3 shows a top plan cross-sectional view of the magnetic separator 1, as seen along line b-b in FIG. 1. As seen in FIG. 3, a plurality of magnetic matrices 3 are provided around a circumference of the rotor 2. FIG. 4 shows the rotor 2 in isolation, with a close-up on a magnetic matrix 3. As seen in this view, each magnetic matrix 3 is formed with a plurality of grooved plates 4, with each plate 4 separated from one another by a gap 5 that extends entirely vertically through the matrix 3.

As seen in FIGS. 1-3, the rotor 2 is flanked on opposite sides by the pair of diametrically opposed metal plates 7/8 that are each provided with electromagnetic coils 6 (contained inside a housing) for generating a magnetic field 9 between a north magnetic pole 7 and a south magnetic pole 8. The poles 7/8 are positioned adjacent to the rotor 2 such that the magnetic field 9 extends through the rotor 2, including the plates 4 and gaps 5 of the matrices 3.

In operation, the rotor 2 rotates around a central axis (e.g., clockwise in this example) so that each matrix 3 passes under a slurry inlet 11 positioned proximate a leading edge of the south magnetic pole 8. As a matrix 3 passes under the slurry inlet 11, a slurry is fed from the inlet 11 into an upper end of the matrix 3 and through gaps 5 between grooved plates 4 thereof. The slurry feed is a semi-liquid mixture comprising magnetic and non-magnetic particles suspended in a liquid medium. Owing to the strong magnetic field 9 generated within the matrix 3 at this time, magnetic particles in the slurry immediately adhere to ridges in the surfaces of the grooved plates 4, while non-magnetic particles continue to pass through the gaps 5, falling out a lower end of the matrix 3, into a collecting launder 12 positioned thereunder for separate collection as a non-magnetic product.

As the rotor 2 continues to rotate clockwise, the matrix 3 subsequently passes under a low-pressure flushing inlet 14 that is positioned proximate to a trailing edge of the south magnetic pole 8. The low-pressure flushing inlet 14 ejects a low-pressure flushing liquid into the upper end of the matrix 3, and through gaps 5 between plates 4 thereof. Introduction of the low-pressure flushing liquid removes non-magnetic particles that were trapped in the matrix 3 by magnetic particles adhered to the surfaces of the grooved plates 4. The low-pressure flushing liquid and non-magnetic particles removed thereby flow through the gaps 5, falling out the lower end of the matrix 3, into a collecting launder 15 positioned beneath the rotor 2, for separate collection as a middling product.

As the rotor 2 continues to rotate clockwise, the matrix 3 subsequently passes under a high-pressure flushing inlet 16 that is positioned along a neutral line 10 that is approximately equidistant between the north and south magnetic poles 7/8. The neutral line 10 represents a region with substantially zero magnet field such that matrices 3 are substantially demagnetized while passing through that region. The high-pressure flushing inlet 16 ejects a high-pressure flushing liquid into the upper end of the matrix 3, and through gaps 5 between plates 4 thereof. Delivery of this high-pressure liquid removes the magnetic particles from the demagnetized grooved plates 4, with the flushing liquid and magnetic particles flowing through the gaps 5, falling out the lower end of the matrix 3, into a collecting launder 17 positioned beneath the rotor 2, for separate collection as a magnetic product.

As the rotor 2 continues to rotate clockwise, the foregoing process described relative to the south magnetic pole 8 is then repeated at the north magnetic pole 7, with a slurry inlet positioned at a leading edge of the north magnetic pole 7, a low-pressure flushing inlet positioned at a trailing edge of the north magnetic pole 7, and a high-pressure flushing inlet positioned along the neutral line 10 at a side of the rotor 2 opposite the high-pressure flushing inlet 16. The lower rotor 2 operates in the same manner as the upper rotor 2, with the exception that the poles 7/8 flanking the lower rotor 2 are provided with reverse polarities relative to the poles 7/8 that flank the upper rotor 2. With this arrangement, the magnetic separator 1 is adapted so that each matrix 3 may complete two separation cycles over the course of single revolution of the rotor 2, with one cycle at each magnetic pole.

Figure 5:
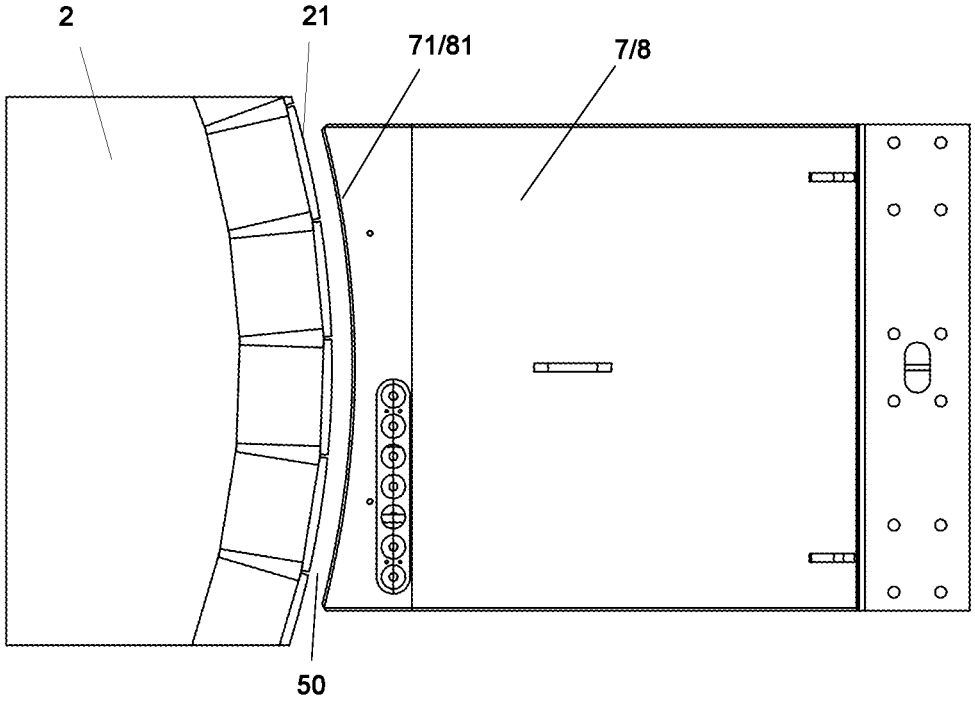
FIG. 5 shows a top plan view of an interface between a rotor and a magnetic pole in the magnetic separator of FIG. 1.

During operation of the magnetic separator 1, the rotor 2 rotates in relatively close proximity to the magnetic poles 7/8 (e.g., approximately $1/8^{th}$ in.), while receiving a slurry feed from the slurry inlet 11 and a low-pressure flushing liquid from the flushing inlet 14 that pass through the matrices 3. Inevitably, some volume of the slurry feed deviates from the intended course through a matrix 3 (i.e., diverted feed) and instead passes through a space 50 between an outer edge 21 of the rotor 2 and a forward face 71/81 of the corresponding pole 7/8, as shown in FIG. 5. As this diverted feed passes through the space 50, particles in this diverted feed (i.e., errant particles) cause wear to the face 71/81 of the pole 7/8. Eventually, substantial wear to the face 71/81 results in irregularities in the magnetic field 9, which leads to a lesser efficiency in capturing magnetic particles within the matrices 3, with diminishing output of the magnetic separator 1.

Figure 6:
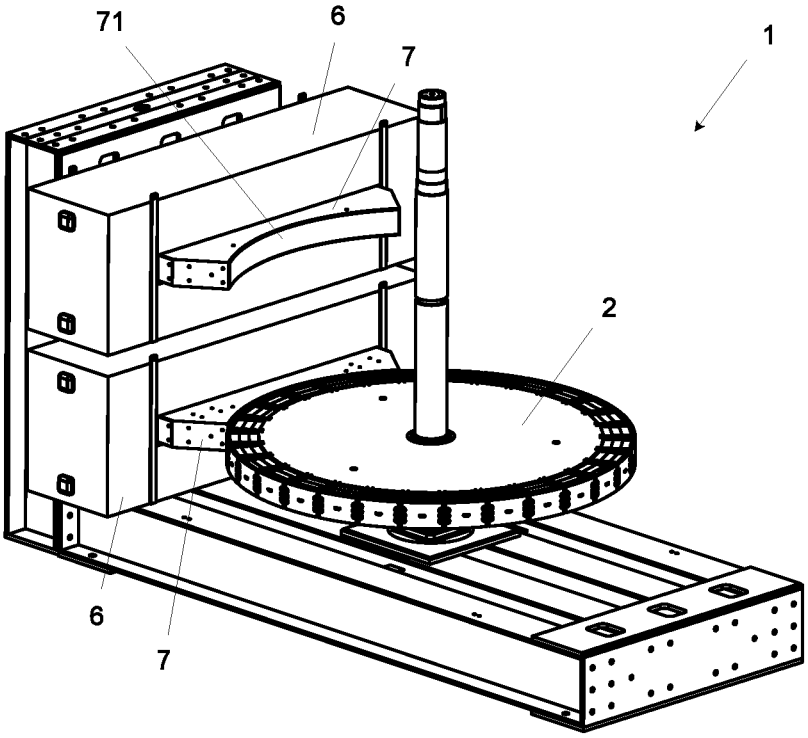
FIG. 6 shows the magnetic separator of FIG. 1 in a disassembled state.
Figure 7:
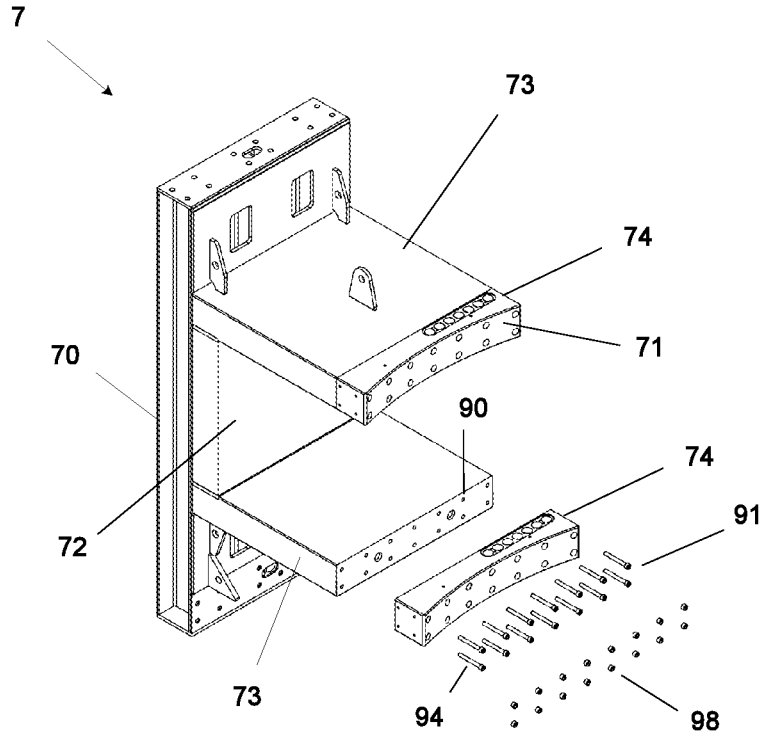
FIG. 7 shows an example of a magnetic pole according to the present invention.
Figure 8:
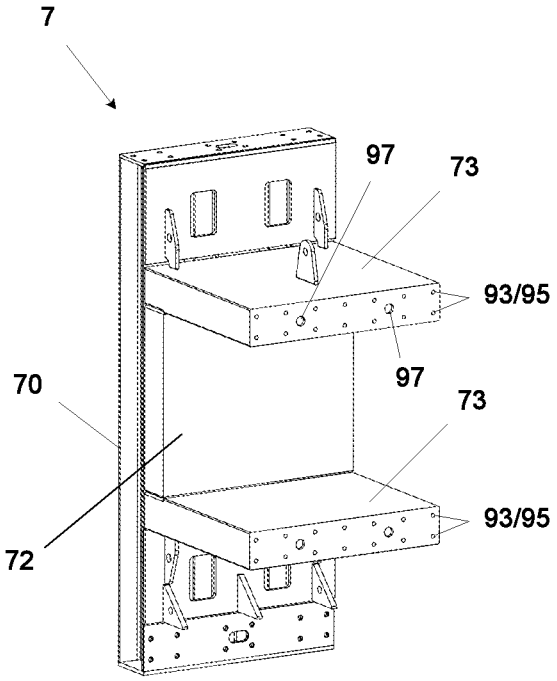
FIG. 8 shows the interface of the cantilevered pole arm in the magnetic pole of FIG. 7.
Figure 9:
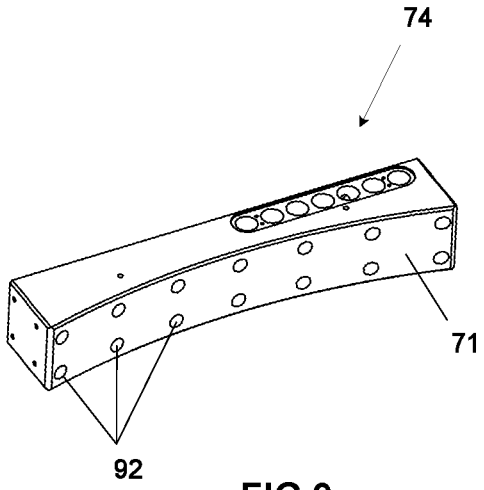
FIG. 9 shows a faceplate of the magnetic pole of FIG. 7.

Wear to the face 71/81 of a magnetic pole 7/8 is known in the art, and conventional attempts to remedy this issue have included filling scratches along the worn surfaces with welding materials followed by surface machining to bring the face 71/81 into conformity. However, this conventional practice is labor intensive, requiring disassembly of the magnetic separator 1 with temporary removal of the rotor 2, as seen in FIG. 6, to permit access to the face 71/81 of the poles 7/8 for welding and machining. The rotor 2 in a conventional magnetic separator 1 is typically on the magnitude of several tons in weight, such that removal thereof requires high-load bearing heavy equipment. Furthermore, welding and machining of the poles 7/8 is a complex process due to the presence of residual magnetic fields within the metals, with the process typically requiring anywhere from several days to a few weeks to complete, during which time the magnetic separator 1 is offline resulting a total loss of throughput from the system. Even after completion of the process, imprecisions in the welding and machining to a face 71/81 will result in persistent irregularities in the magnetic field 9, with continued losses to efficiency of the system.

FIGS. 7-12 show one example of a magnetic pole 7 according to the present invention. The magnetic pole 7 has a body 70 with central core 72 and two cantilevered pole arms 73 extending perpendicularly from the core 72, the pole arms 73 both having removable faceplates 74 at the ends thereof. The cantilevered pole arms 73 and faceplates 74 are provided with mating connection mechanisms 90/91 that enable selective removal and re-attachment of the faceplates 74.

In this example, the connection mechanisms 90/91 are inclusive of a series of through-holes 92 formed through the faceplate 74, a series of blind holes 93 formed in the cantilevered pole arm 73 and positioned to align with the through-holes 92 in the faceplate 74, and a number of first and second fastener elements 94/95. The first fastener elements 94 are adapted to extend through the through-holes 92 in the faceplate 74 and into the blind holes 93 of the cantilevered pole arm 73 for mating engagement with the second fastener elements 95 positioned within the blind holes 93. In this example, the through-holes 92 and blind holes 93 are oriented to extend in parallel with a length of the cantilevered pole arm 73, with the openings of the through-holes 92 oriented to face toward and oppose the outer surface 21 of a rotor 2 when positioned in an operational state in a magnetic separator. Mating first and second fastener elements suitable for use in this example include, though are not limited to, mating arrangements of threaded shafts (e.g., screws) and threaded walls within the blind holes.

With the construction in this example, when the outward face 71 of the magnetic pole 7 has become excessively worn, the faceplate 74 may simply be replaced by releasing the fastener elements 94/95, detaching the worn faceplate 74 from the cantilevered pole arm 73, and attaching a replacement faceplate 74 via re-engagement of the fastener elements 94/95. The replacement faceplate 74 may either be a new, previously unused faceplate or an old, prior-used faceplate that has since been repaired. Since the through-holes 92 in the faceplate 74 open at a surface that, in an operational state, will oppose an outer surface 21 of the rotor 2, it will remain necessary that the rotor 2 be removed in order to access the first fastener elements 94 in the through-holes 92 for removing and replacing a worn faceplate 74. This arrangement remains beneficial, however, as mere replacement of the worn faceplate 74 with a replacement faceplate 74 is more efficient than machining a worn face of a cantilevered pole arm 73.

Figure 10:
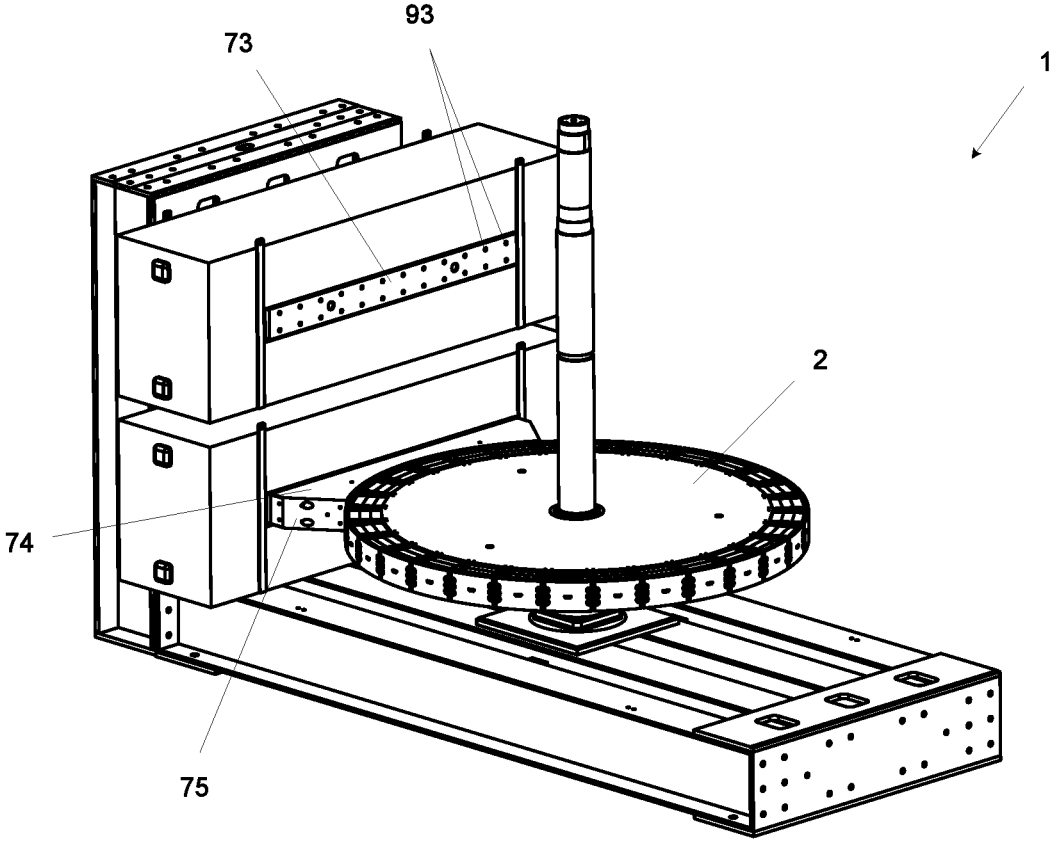
FIG. 10 shows a magnetic separator, with a variation of the magnetic pole of FIG. 7, in a disassembled state.
Figure 11:
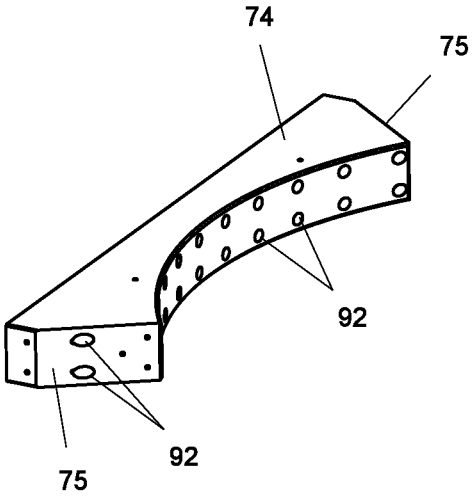
FIG. 11 shows a front perspective view of a variation of the faceplate of FIG. 9.
Figure 12:
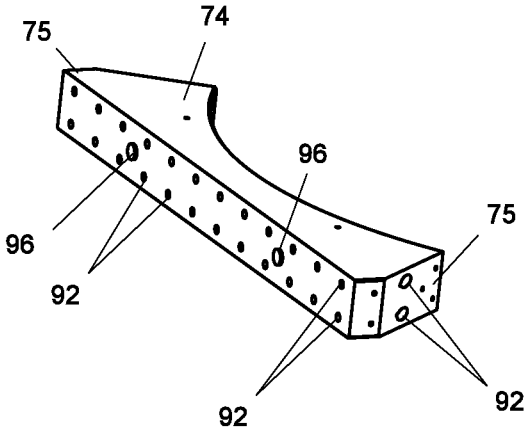
FIG. 12 shows a rear perspective view of the faceplate of FIG. 11.

Optionally, as shown in FIGS. 10-12, the faceplate 74 may be provided with a pair of chamfered surfaces 75 at lateral ends thereof, with the chambered surfaces 75 oriented at an oblique angle to leave them exposed, free from obstruction by the rotor 2, when positioned in an operational state. These chambered surfaces 75 may be provided with a number of through-holes 92 that align with blind holes 93 in the cantilevered pole arm 73 for fixation by mating fastener elements 94/95. With this arrangement, there is an option of securing the faceplate 74 to the cantilevered pole arm 73 via use of only the through-holes 92 at the chamfered surfaces 95, while foregoing use of through-holes 92 that would be obstructed in an operational state by the rotor 2. If secured in this way, it is then possible to release the fastener elements 94/92 at the exposed chamfered surfaces 95, remove the worn faceplate 74 by a vertical displacement, insert a replacement faceplate 74 by a similar vertical displacement, and re-engage the fastener elements 94/95 to secure the replacement faceplate 74 in place, all without having to disassemble the system to remove the rotor 2.

Optionally, the faceplate 74 and cantilevered pole arm 73 may also include a number of protuberances 96 (FIG. 12) at a surface of one of the two structures and corresponding recesses 97 (FIG. 8) at a surface of the second of the two structures, with the protuberances 96 and recesses 97 adapted and positioned for reception of the protuberances 96 within the recesses 97 when the faceplate 74 is properly aligned with the cantilevered pole arm 73. Such mating protuberances 96 and recesses 97 may serve as guides for facilitating proper alignment of a faceplate 74 on a cantilevered pole arm 73. There may also be provided a protective barrier 98 (FIG. 7) for closing through-holes 92 after engagement of mating fastener elements 94/95 so to prevent damage to the first fasteners 94 secured therein during an operational state of the system. Protective barriers suitable for use include, though are not limited to, a removable cap, a removable plug, a quantity of fill material that can be easily extracted or machined away (e.g., polyurethane).

FIGS. 13-18 show a further example of a magnetic pole 7 according to the present invention. As with the former example, this magnetic pole 7 has a body 70 with central core 72 and two cantilevered pole arms 73 extending perpendicular from the core 72, the pole arms 73 both having removable faceplates 74 at the ends thereof. The cantilevered pole arms 73 and faceplates 74 are provided with mating connection mechanisms 90/91 that enable selective removal and re-attachment of the faceplates 74.

In this example, the connection mechanisms 90/91 are inclusive of correspondingly shaped contoured surfaces 100/101 at the respective mating surfaces of the cantilevered pole arm 73 and the faceplate 74. In the example shown in FIGS. 13-18, the cantilevered pole arm 73 and the faceplate 74 are provided with contoured surfaces 100/101 in the form of stepped surfaces 100/101, each having at least one relatively recessed region **100*a*/101*a* and one relatively protruding region 100*b*/101*b*. The mating stepped surfaces 100/101 are made to complement one another, for example, by having the relatively protruding region 100*b* in the first stepped surface 100 align for reception in the relatively recessed region 101*a* in the second stepped surface 101 while concurrently having the relatively protruding region 101*b* in the second stepped surface 101 align for reception in the relatively recessed region 100*a* in the first stepped surface 100, such that concurrent reception of these mating surfaces provides a uniform reception of the faceplate 74 at an end of the cantilevered pole arm 73**.

The connection mechanisms 90/91 in this example are further inclusive of a series of through-holes 92 formed through the faceplate 74, a series of blind holes 93 formed in the cantilevered pole arm 73, and a number of first and second fastener elements 94/95. As with the prior example, the first fastener elements 94 are adapted to extend through the through-holes 92 in the faceplate 74 and into the blind holes 93 of the cantilevered pole arm 73 for mating engagement with second fastener elements 95 within the blind holes 93.

Unlike the prior example, the through-holes 92 and blind holes 93 in this example are oriented to extend in a direction perpendicular to a length of the cantilevered pole arm 73, with the openings of the through-holes 92 oriented to face in a direction that is free from obstruction by an outer surface 21 of a rotor 2 when the faceplate 74 is positioned in an operational state in a magnetic separator, and preferably in a direction that leaves the through-holes 92 accessible during such an operational state. Mating first and second fastener elements suitable for use in this example include, though are not limited to, mating arrangements of threaded shafts (e.g., screws) and threaded walls within the blind holes.

Figure 13:
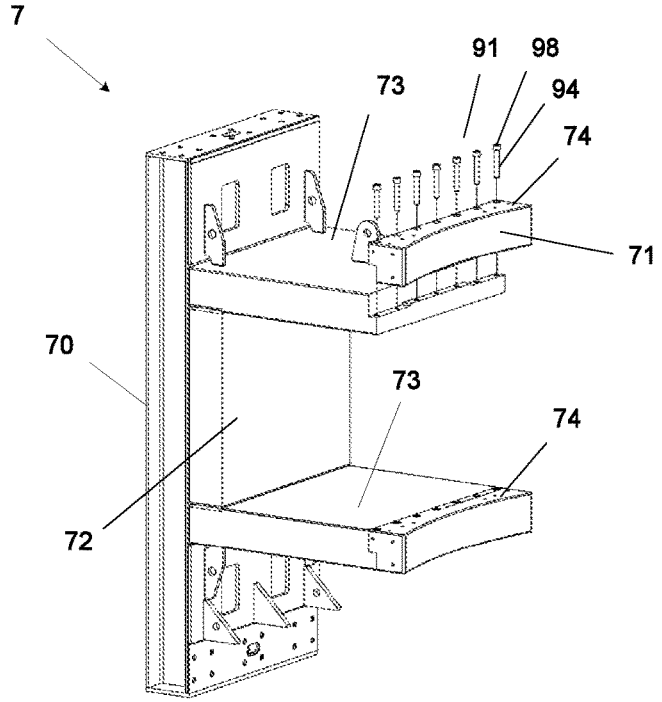
FIG. 13 shows another example of a magnetic pole according to the present invention.
Figure 14:
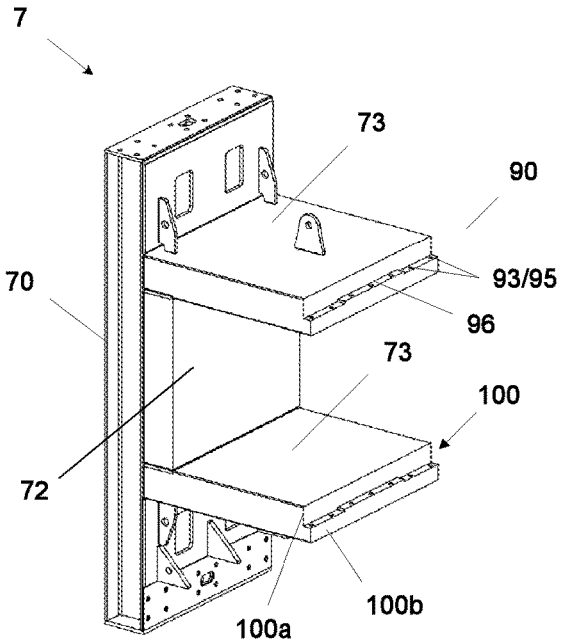
FIG. 14 shows the interface of the cantilevered pole arm in the magnetic pole of FIG. 13.
Figure 15A:
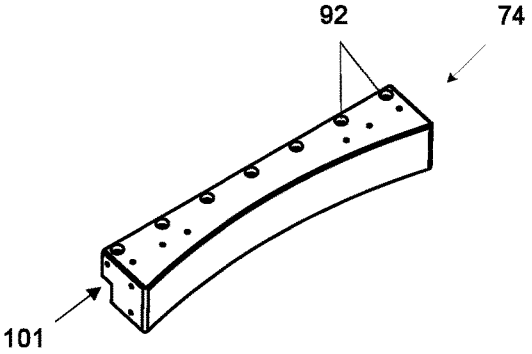
FIG. 15*a* shows a front perspective view of the faceplate of the magnetic pole of FIG. 13.
Figure 15B:
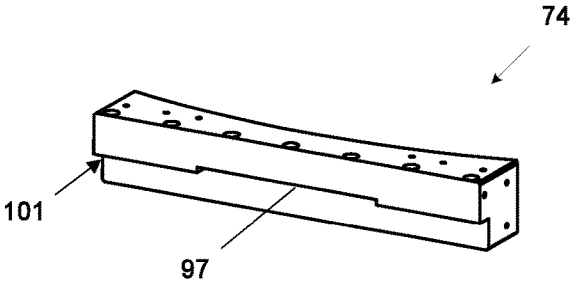
FIG. 15*b* shows a rear perspective view of the faceplate of FIG. 15*a;*
Figure 16:
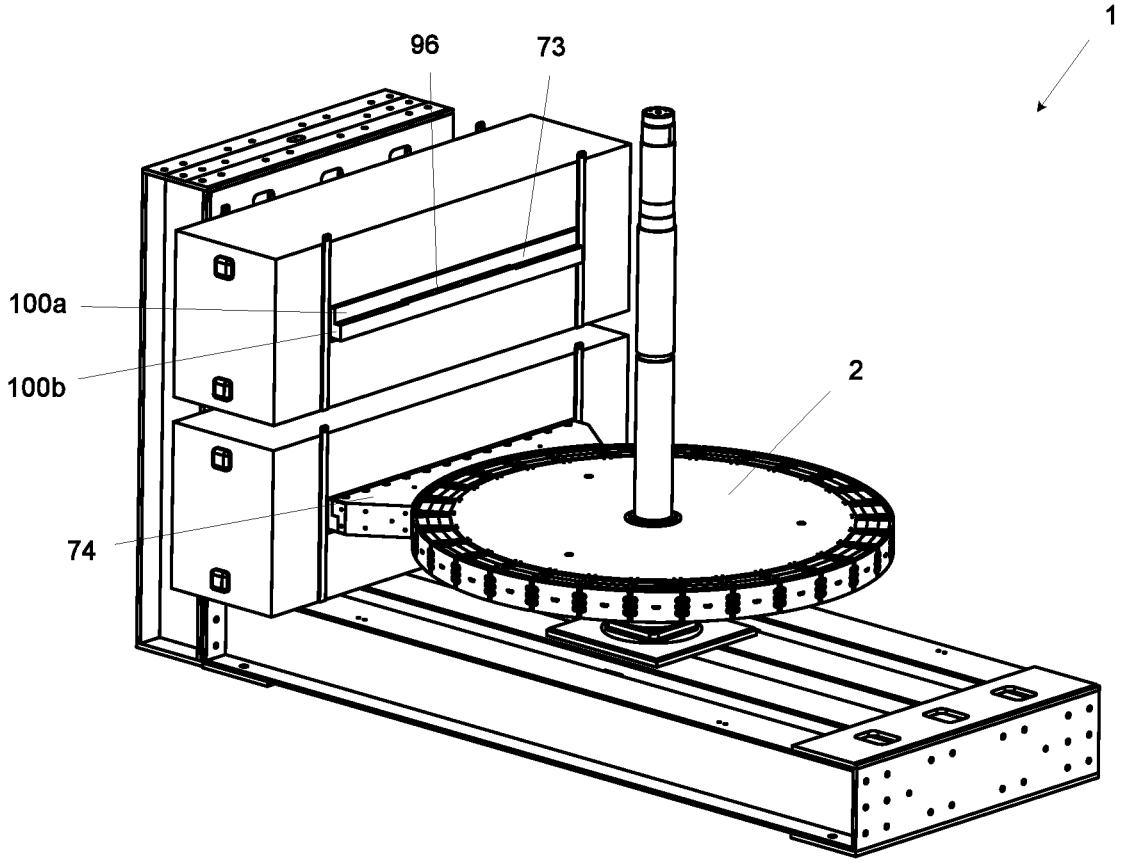
FIG. 16 shows a magnetic separator with the magnetic pole of FIG. 13.
Figure 17:
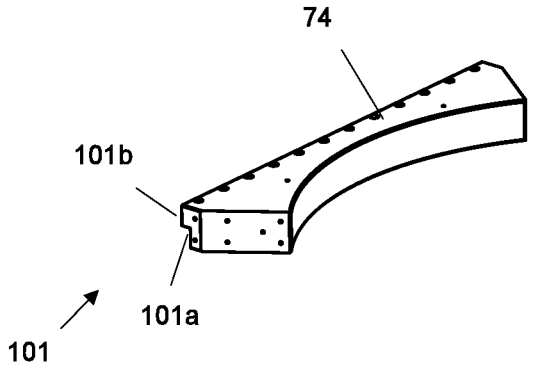
FIG. 17 shows a front perspective view of a variation of the faceplate of FIG. 15*a;*
Figure 18:
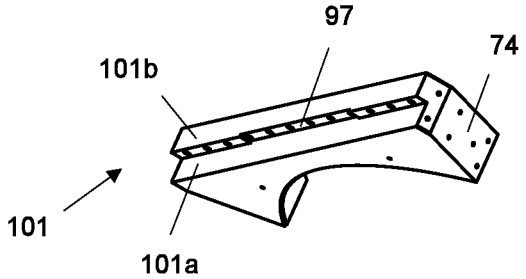
FIG. 18 shows a rear perspective view of the faceplate of FIG. 17.

In this example, with the through-holes 92 free from obstruction by the rotor 2, and otherwise accessible while the faceplate 74 is in an operational state, a worn faceplate 74 may be removed and a replacement faceplate 74 inserted without disassembling the system to remove the rotor 2. For example, as shown in FIG. 13, the fastener elements 94/95 may be released from a vertical orientation, with a worn faceplate 74 then removed by a vertical displacement, and a replacement faceplate 74 inserted by a similar vertical displacement, with subsequent re-engagement of the fastener elements 94/95 to secure the replacement faceplate 74, all without having to disassemble the system to remove the rotor 2.

Optionally, the faceplate 74 and cantilevered pole arm 73 may also include a number of protuberances 96 (FIG. 14) provided on a surface of one of the two structures, with a corresponding number of recesses 97 (FIG. 18) provided on a surface of the second of the two structures, with the protuberances 96 and recesses 97 adapted and positioned for reception of the protuberances 96 within the recesses 97 when the faceplate 74 is properly aligned with the cantilevered pole arm 73. Such mating protuberances 96 and recesses 97 may serve as guides for facilitating proper alignment on the faceplate 74 with the cantilevered pole arm 73. As with the former example, there may also be provided a protective barrier 98 (FIG. 13) to close the through-holes 92 following engagement of the fastener elements 94/95, so as to prevent damage to the first fasteners 94 secured therein.

FIGS. 19-25 show further examples of replaceable faceplates 74 according to the present invention. As with the former examples, the faceplates 74 are likewise adapted for use with a magnetic pole 7 having a body 70 with a central core 72 and two cantilevered pole arms 73 extending perpendicular from the core 72, with the removable faceplates 74 adapted for connection to ends of the cantilevered pole arms 73 by mating connection mechanisms 90/91 that enable selective removal and re-attachment of the faceplates 74.

In these examples, the connection mechanisms 90/91 are inclusive of correspondingly shaped contoured surfaces 102/103 at the respective mating surfaces of the cantilevered pole arm 73 and the faceplate 74, though in these examples the contoured surfaces 102/103 are adapted for securing the faceplates 74 to the ends of the cantilevered pole arms 73 without further need of fastener elements.

Figure 19:
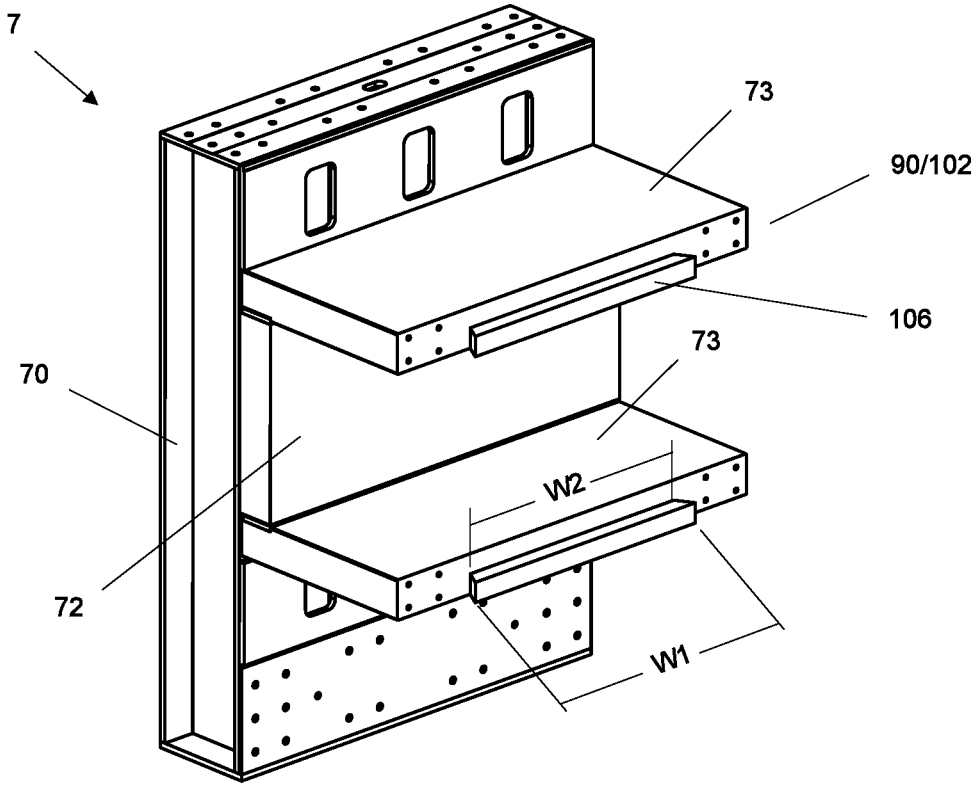
FIG. 19 shows another example of an interface of the cantilevered pole arm according to the present invention.
Figure 20:
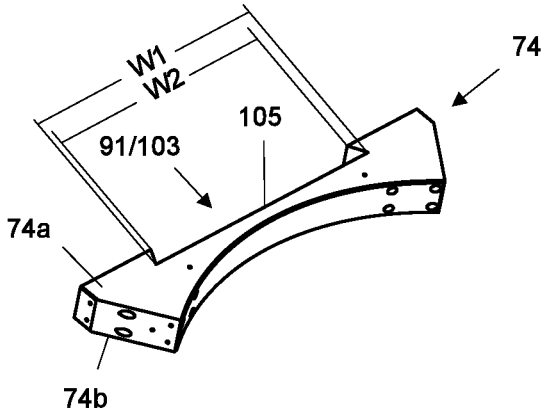
FIG. 20 shows a bottom perspective view of a faceplate for mating with the interface in FIG. 19.
Figure 21:
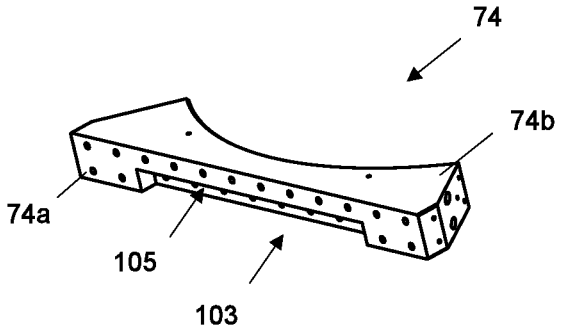
FIG. 21 shows a rear perspective view of the faceplate in FIG. 20.

In the example shown in FIGS. 19-21, the cantilevered pole arm 73 and faceplate 74 are provided with mating contoured surfaces 102/103 that together form of a dovetail joint. The faceplate 74 is provided with a dovetail recess 105 that opens at a lower surface 74*a* of the faceplate 74 and extends partially through a height of the faceplate 74, with an inner edge of the dovetail recess 105 made to have a relatively larger dimension $W_1$ and an outer opening edge of the dovetail recess 105 made to have a relatively smaller dimension $W_2$. The cantilevered pole arm 73 is provided with a corresponding mating dovetail protuberance 106 that extends from a forward surface of the cantilevered pole arm 73, with an outer edge of the dovetail protuberance 106 made to have a relatively larger dimension $W_1$ and an inner edge of the dovetail protuberance 106 made to have a relatively smaller dimension $W_2$. With this construction, the faceplate 74 may be joined to the cantilevered pole arm 73 by a vertical displacement in which the dovetail protuberance 106 on the cantilevered pole arm 73 is slid vertically into the dovetail recess 105 through the recessing opening at the lower surface 74*a* of the faceplate 74, with an upper surface of the dovetail recess 105 coming to rest on an upper surface of the dovetail protuberance 106 to form a dovetail joint that fixes the faceplate 74 in position at and end of the cantilevered pole arm 73.

Optionally, the cantilevered pole arm 73 may further be provided with a sliding gate (not shown) that moves horizontally between an extended position in which the gate partially covers the upper surface 74*b* of a faceplate 74 received on the cantilevered pole arm 73, and a retracted position in which the gate is withdrawn from covering any portion of the upper surface 74*b* of a faceplate 74 received on the cantilevered pole arm 73. When included, such a sliding gate may be placed in an extended position to further secure a faceplate 74 such as that shown in FIGS. 19-21 in place on the end of the cantilevered pole arm 73 to prevent any unintentional vertical movement that might otherwise cause the faceplate 74 to slide out of the dovetail joint; and the sliding gate may be placed in the retracted position to permit removal of a worn faceplate 74 and insertion of a replacement faceplate 74.

Figure 22:
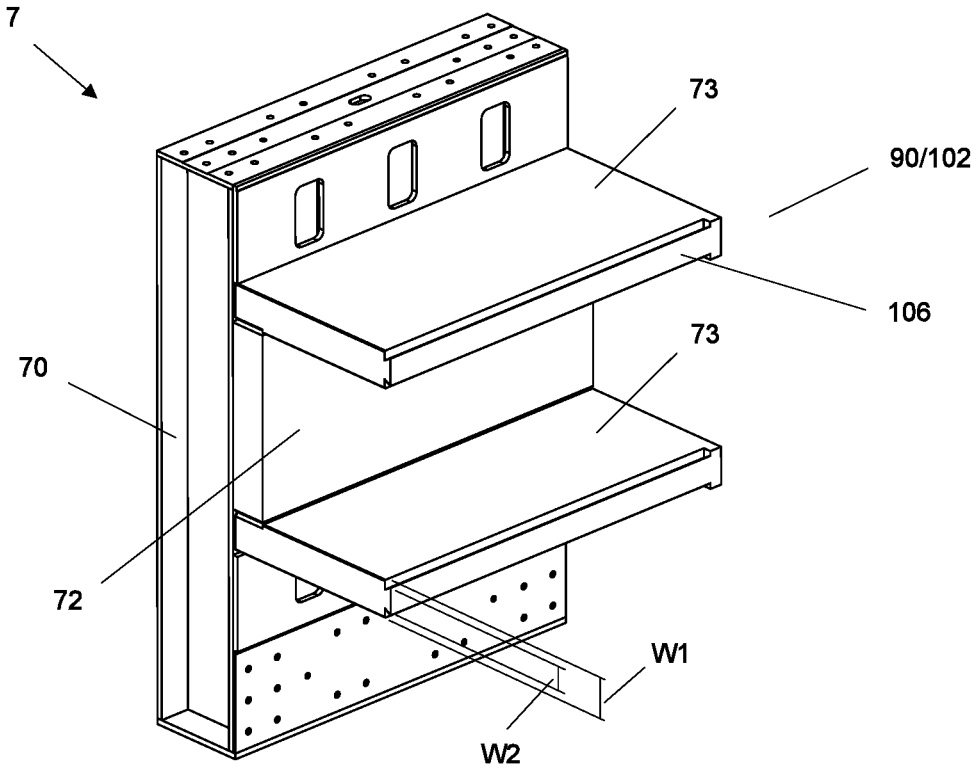
FIG. 22 shows another example of an interface of the cantilevered pole arm according to the present invention.
Figure 23:
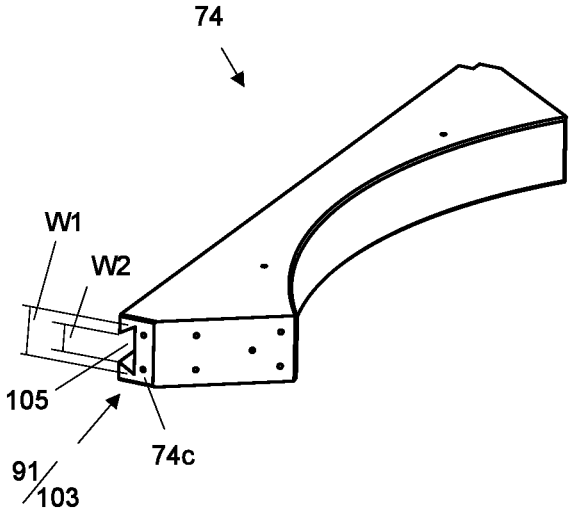
FIG. 23 shows a front perspective view of a faceplate for mating with the interface in FIG. 22.
Figure 24:
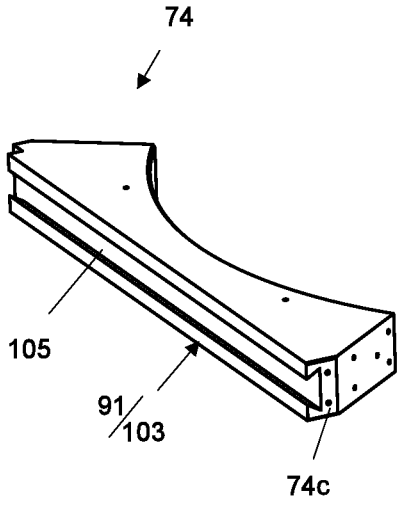
FIG. 24 shows a rear perspective view of the faceplate in FIG. 23.

In the example shown in FIGS. 22-24, the cantilevered pole arm 73 and the faceplate 74 are provided with mating contoured surfaces 102/103 that together form of a dovetail joint. The faceplate 74 is provided with a dovetail recess 105 that opens at a first side 74*c* of the faceplate 74 and extends partially through a width of the faceplate 74, with an inner edge of the dovetail recess 105 made to have a relatively larger dimension $W_1$ and an outer opening edge of the dovetail recess 105 made to have a relatively smaller dimension $W_2$. The cantilevered pole arm 73 is provided with a mating dovetail protuberance 106 that extends from a forward surface of the cantilevered pole arm 73, with an outer edge of the dovetail protuberance 106 made to have a relatively larger dimension $W_1$ and an inner edge of the dovetail protuberance 106 made to have a relatively smaller dimension $W_2$. With this construction, the faceplate 74 may be joined to the cantilevered pole arm 73 by a horizontal displacement in which the dovetail protuberance 106 on the cantilevered pole arm 73 is slid laterally into the opening of the dovetail recess 105 at the side surface 74*c* of the faceplate 74, with an opposite closed end of the dovetail recess 105 coming to rest against an abutment at an end of the dovetail protuberance 106 to form a dovetail joint that fixes the faceplate 74 in position at and end of the cantilevered pole arm 73. Preferably, the faceplate 74 is adapted for being slid onto the cantilevered pole arm 73 through a lateral sliding in a direction tangential to the circumference of the rotor 2 and along a vector corresponding to a rotation direction of the rotor 2. In this way, removal of the faceplate 74 from the cantilevered pole arm 73 would require sliding the faceplate 74 in a direction tangential to the circumference of the rotor 2 though along a vector opposite to a rotation direction of the rotor 2. With this arrangement, it is unlikely that the faceplate 74 could unintentionally slide out of the dovetail joint.

Optionally, the cantilevered pole arm 73 may be further provided with a sliding gate (not shown) that moves horizontally between an extended position in which the gate partially covers the side surface 74*c* of a faceplate 74 received on the cantilevered pole arm 73, and a retracted position in which the gate is withdrawn from covering any portion of a side surface 74*c* of a faceplate 74 received on the cantilevered pole arm 73. When included, such a sliding gate may be placed in an extended position to further secure a faceplate 74 such as that shown in FIGS. 22-24 in place on the end of the cantilevered pole arm 73 to prevent any unintentional horizontal movement that might otherwise cause the faceplate 74 to slide out of the dovetail joint; and the sliding gate may be placed in the retracted position to permit removal of a worn faceplate 74 and insertion of a replacement faceplate 74.

While the examples shown in FIGS. 19-24 are presented with a faceplate 74 being provided with a dovetail recess 105 and a cantilevered pole arm 73 being provided with a dovetail protuberance 106, in other examples the faceplate 74 may be provided with a dovetail protuberance and the cantilevered pole arm 73 may be provided with a dovetail recess. In these examples, when the cantilevered pole arm 73 is provided with a dovetail recess, the cantilevered pole arm 73 will have a recess opening on a corresponding upper or side surface, as disclosed in the foregoing examples relative to the faceplate 74. Also, while the examples shown in FIGS. 19-24 are adapted for securing the faceplates to the cantilevered pole arms 73 via fixation of the contoured surfaces 102/103 alone, these examples may optionally further include one or more additional connection mechanisms, such as the through-holes, blind holes and fastener elements disclosed in any and all of the prior examples.

Although the present invention is described with reference to particular embodiments, it will be understood to those skilled in the art that the foregoing disclosure addresses exemplary embodiments only; that the scope of the invention is not limited to the disclosed embodiments; and that the scope of the invention may encompass any combination of the disclosed embodiments, in whole or in part, as well as additional embodiments embracing various changes and modifications relative to the examples disclosed herein without departing from the scope of the invention as defined in the appended claims and equivalents thereto.

To the extent necessary to understand or complete the disclosure of the present invention, all publications, patents, and patent applications mentioned herein are expressly incorporated by reference herein to the same extent as though each were individually so incorporated. No license, express or implied, is granted to any patent incorporated herein.

The present invention is not limited to the exemplary embodiments illustrated herein, but is instead characterized by the appended claims, which in no way limit the scope of the disclosure.

What is claimed is:

1. A pole for use in a magnetic separator, comprising:

a body having a central core and two cantilevered pole arms, each pole arm extending at a perpendicular angle relative to the central core and having a faceplate at and end thereof, wherein at least one cantilevered pole arm and corresponding faceplate are provided with a connection mechanism that facilitates selective removal and re-attachment of the faceplate with the cantilevered pole arm, the connection mechanism comprising a number of mating first and second fastener elements adapted to engage one another for selectively securing the faceplate with the cantilevered pole arm;

the first fastener elements comprise a number of threaded shafts adapted for passing through through-holes in the faceplate and the second fastener elements comprise a number of corresponding threads provided within blind holes in the cantilevered pole arm, with the threaded shafts and corresponding threads in the blind holes being configured to selectively engage and disengage one another for selectively attaching and removing the faceplate with the cantilevered pole arm, the through-holes in the faceplate and the blind holes in the cantilevered pole arm extending in a direction parallel with a length of the cantilevered pole arm; and at least one of the cantilevered pole arm and the faceplate comprises a protuberance, and the other of the cantilevered pole arm and the faceplate comprises a recess, the protuberance and the recess being configured for mating engagement with reception of the protuberance in the recess such that mating engagement of the protuberance within the recess positions the faceplate relative to the cantilevered pole arm for alignment of the through-holes in the faceplate with the blind-holes in the cantilevered pole arm.

2. The pole according to claim 1, wherein the connection mechanism comprises mating first and second contoured surfaces adapted to engage one another for selectively securing the faceplate with the cantilevered pole arm.

3. The pole according to claim 2, wherein the mating first and second contoured surfaces comprise stepped surfaces, each having a relatively recessed region and a relatively protruding region, with the relatively protruding region of the stepped surface in the faceplate being adapted for reception in the relatively recessed region of the stepped surface in the cantilevered pole arm, and the relatively protruding region of the stepped surface in the cantilevered pole arm being adapted for reception in the relatively recessed region of the stepped surface in the faceplate.

4. The pole according to claim 2, wherein the mating first and second contoured surfaces are configured to join one another to form a dovetail joint.

5. The pole according to claim 4, wherein one of the cantilevered pole arm and the faceplate is provided with a dovetail recess and the other of the cantilevered pole arm and the faceplate is provided with a dovetail protuberance, the dovetail protuberance being dimensioned for reception within the dovetail recess via a horizontal sliding movement in which the dovetail protuberance is horizontally slid through a recess opening of the dovetail recess in a side surface.

6. The pole according to claim 4, wherein one of the cantilevered pole arm and the faceplate is provided with a dovetail recess and the other of the cantilevered pole arm and the faceplate is provided with a dovetail protuberance, the dovetail protuberance being dimensioned for reception within the dovetail recess via a vertical sliding movement in which the dovetail protuberance is vertically slid through a recess opening of the dovetail recess in an upper surface.

7. A magnetic separator comprising the pole of claim 1.

8. The pole according to claim 1, wherein the faceplate comprises one or more chamfered surfaces oriented at an oblique angle relative to the length of the cantilevered pole arm.

9. A pole for use in a magnetic separator, comprising:

a body having a central core and two cantilevered pole arms, each pole arm extending at a perpendicular angle relative to the central core and having a faceplate at and end thereof, wherein at least one cantilevered pole arm and corresponding faceplate are provided with a connection mechanism that facilitates selective removal and re-attachment of the faceplate with the cantilevered pole arm, the connection mechanism comprising a number of mating first and second fastener elements adapted to engage one another for selectively securing the faceplate with the cantilevered pole arm;

the first fastener elements comprise a number of threaded shafts adapted for passing through through-holes in the faceplate and the second fastener elements comprise a number of corresponding threads provided within blind holes in the cantilevered pole arm, with the threaded shafts and corresponding threads in the blind holes being configured to selectively engage and disengage one another for selectively attaching and removing the faceplate with the cantilevered pole arm, the through-holes in the faceplate and the blind holes in the cantilevered pole arm extending in a direction parallel with a length of the cantilevered pole arm; and the faceplate comprises one or more chamfered surfaces oriented at an oblique angle relative to the length of the cantilevered pole arm.

10. The pole according to claim 9, wherein the connection mechanism comprises mating first and second contoured surfaces adapted to engage one another for selectively securing the faceplate with the cantilevered pole arm.

11. The pole according to claim 10, wherein the mating first and second contoured surfaces comprise stepped surfaces, each having a relatively recessed region and a relatively protruding region, with the relatively protruding region of the stepped surface in the faceplate being adapted for reception in the relatively recessed region of the stepped surface in the cantilevered pole arm, and the relatively protruding region of the stepped surface in the cantilevered pole arm being adapted for reception in the relatively recessed region of the stepped surface in the faceplate.

12. The pole according to claim 10, wherein the mating first and second contoured surfaces are configured to join one another to form a dovetail joint.

13. The pole according to claim 12, wherein one of the cantilevered pole arm and the faceplate is provided with a dovetail recess and the other of the cantilevered pole arm and the faceplate is provided with a dovetail protuberance, the dovetail protuberance being dimensioned for reception within the dovetail recess via a vertical sliding movement in which the dovetail protuberance is vertically slid through a recess opening of the dovetail recess in an upper surface.

14. The pole according to claim 12, wherein one of the cantilevered pole arm and the faceplate is provided with a dovetail recess and the other of the cantilevered pole arm and the faceplate is provided with a dovetail protuberance, the dovetail protuberance being dimensioned for reception within the dovetail recess via a horizontal sliding movement in which the dovetail protuberance is horizontally slid through a recess opening of the dovetail recess in a side surface.

15. A magnetic separator comprising the pole of claim 9.

16. A pole for use in a magnetic separator, comprising:

a body having a central core and two cantilevered pole arms, each pole arm extending at a perpendicular angle relative to the central core and having a faceplate at and end thereof, wherein at least one cantilevered pole arm and corresponding faceplate are provided with a connection mechanism that facilitates selective removal and re-attachment of the faceplate with the cantilevered pole arm, the connection mechanism comprising a number of mating first and second fastener elements adapted to engage one another for selectively securing the faceplate with the cantilevered pole arm; and the first fastener elements comprise a number of threaded shafts adapted for passing through through-holes in the faceplate and the second fastener elements comprise a number of corresponding threads provided within blind holes in the cantilevered pole arm, with the threaded shafts and corresponding threads in the blind holes being configured to selectively engage and disengage one another for selectively attaching and removing the faceplate with the cantilevered pole arm, the through-holes in the faceplate and the blind holes in the cantilevered pole arm extending in a direction perpendicular with a length of the cantilevered pole arm.

17. The pole according to claim 16, wherein at least one of the cantilevered pole arm and the faceplate comprises a protuberance, and the other of the cantilevered pole arm and the faceplate comprises a recess, the protuberance and the recess being configured for mating engagement with reception of the protuberance in the recess, and mating engagement of the protuberance within the recess positions the faceplate relative to the cantilevered pole arm for alignment of the through-holes in the faceplate with the blind-holes in the cantilevered pole arm.

18. The pole according to claim 16, wherein the faceplate comprises one or more chamfered surfaces oriented at an oblique angle relative to the length of the cantilevered pole arm.

19. The pole according to claim 16, wherein the connection mechanism comprises mating first and second contoured surfaces adapted to engage one another for selectively securing the faceplate with the cantilevered pole arm.

20. The pole according to claim 19, wherein the mating first and second contoured surfaces comprise stepped surfaces, each having a relatively recessed region and a relatively protruding region, with the relatively protruding region of the stepped surface in the faceplate being adapted for reception in the relatively recessed region of the stepped surface in the cantilevered pole arm, and the relatively protruding region of the stepped surface in the cantilevered pole arm being adapted for reception in the relatively recessed region of the stepped surface in the faceplate.

21. The pole according to claim 19, wherein the mating first and second contoured surfaces are configured to join one another to form a dovetail joint.

22. The pole according to claim 21, wherein one of the cantilevered pole arm and the faceplate is provided with a dovetail recess and the other of the cantilevered pole arm and the faceplate is provided with a dovetail protuberance, the dovetail protuberance being dimensioned for reception within the dovetail recess via a vertical sliding movement in which the dovetail protuberance is vertically slid through a recess opening of the dovetail recess in an upper surface.

23. The pole according to claim 21, wherein one of the cantilevered pole arm and the faceplate is provided with a dovetail recess and the other of the cantilevered pole arm and the faceplate is provided with a dovetail protuberance, the dovetail protuberance being dimensioned for reception within the dovetail recess via a horizontal sliding movement in which the dovetail protuberance is horizontally slid through a recess opening of the dovetail recess in a side surface.

24. A magnetic separator comprising the pole of claim 16.

25. A pole for use in a magnetic separator, comprising:

a body having a central core and two cantilevered pole arms, each pole arm extending at a perpendicular angle relative to the central core and having a faceplate at and end thereof, wherein at least one cantilevered pole arm and corresponding faceplate are provided with a connection mechanism that facilitates selective removal and re-attachment of the faceplate with the cantilevered pole arm, the connection mechanism comprising mating first and second contoured surfaces adapted to engage one another for selectively securing the faceplate with the cantilevered pole arm;

the mating first and second contoured surfaces are configured to join one another to form a dovetail joint, with one of the cantilevered pole arm and the faceplate being provided with a dovetail recess and the other of the cantilevered pole arm and the faceplate being provided with a dovetail protuberance, the dovetail protuberance being dimensioned for reception within the dovetail recess via a vertical sliding movement in which the dovetail protuberance is vertically slid through a recess opening of the dovetail recess in an upper surface.

26. The pole according to claim 25, wherein the connection mechanism comprises mating first and second fastener elements adapted to engage one another for selectively securing the faceplate with the cantilevered pole arm.

27. The pole according to claim 26, wherein the first fastener elements comprise a number of threaded shafts adapted for passing through through-holes in the faceplate and the second fastener elements comprise a number of corresponding threads provided within blind holes in the cantilevered pole arm, with the threaded shafts and corresponding threads in the blind holes being configured to selectively engage and disengage one another for selectively attaching and removing the faceplate with the cantilevered pole arm.

28. The pole according to claim 27, wherein the through-holes in the faceplate and the blind holes in the cantilevered pole arm extend in a direction parallel with a length of the cantilevered pole arm.

29. The pole according to claim 25, wherein the through-holes in the faceplate and the blind holes in the cantilevered pole arm extend in a direction perpendicular with a length of the cantilevered pole arm.

30. The pole according to claim 25, wherein the faceplate comprises one or more chamfered surfaces oriented at an oblique angle relative to the length of the cantilevered pole arm.

31. A magnetic separator comprising the pole of claim 25.

* * * * *